US007837058B2

(12) United States Patent
Collins et al.

(10) Patent No.: US 7,837,058 B2
(45) Date of Patent: Nov. 23, 2010

(54) PRODUCT TRANSPORT SYSTEM FOR A VENDING MACHINE

(75) Inventors: Bryan Alan Collins, New Ellenton, SC (US); Paul Hayward Kelly, Anderson, SC (US); Aron Phillip Lewis, Aiken, SC (US); Charles Wayne Percy, Aiken, SC (US); Joshua Robert Powell, Aiken, SC (US); William E. Roe, Aiken, SC (US)

(73) Assignee: Crane Merchandising Systems, Inc., Bridgeton, MO (US)

( * ) Notice: Subject to any disclaimer, the term of this patent is extended or adjusted under 35 U.S.C. 154(b) by 1003 days.

(21) Appl. No.: 11/249,526

(22) Filed: Oct. 14, 2005

(65) Prior Publication Data

US 2007/0108222 A1 May 17, 2007

(51) Int. Cl.
*B65H 3/44* (2006.01)
*G07F 11/00* (2006.01)
*G07F 11/12* (2006.01)

(52) U.S. Cl. ..... 221/123; 221/131; 221/103; 221/6; 221/1; 221/2; 221/4; 221/133; 221/5; 221/7; 221/9; 221/13; 221/15; 221/105; 221/106; 221/247; 221/248; 221/130; 212/319; 414/749

(58) Field of Classification Search ..... 221/131, 221/241, 215, 251, 1, 4, 133, 5, 7, 9, 13, 221/15, 105, 123, 106, 247, 248, 130, 6, 221/103; 212/319; 414/749; 369/38
See application file for complete search history.

(56) References Cited

U.S. PATENT DOCUMENTS 2,514,815 A 7/1950 Warner et al.
2,735,578 A 2/1956 Woodruff
3,294,282 A 12/1966 Brown
3,348,732 A * 10/1967 Schwarz ..... 221/123
4,483,459 A 11/1984 Taylor et al.
4,560,088 A 12/1985 Tan
4,600,121 A * 7/1986 Falk et al. ..... 221/130
5,128,912 A * 7/1992 Hug et al. ..... 369/30.61
5,139,384 A * 8/1992 Tuttobene ..... 414/281

(Continued)

FOREIGN PATENT DOCUMENTS

JP 402012498 A 1/1990

(Continued)

*Primary Examiner*—Gene O. Crawford
*Assistant Examiner*—Rakesh Kumar

(57) ABSTRACT

A product delivery system for a vending machine includes first and second guide rails and a carriage rail. The guide rails are fixedly mounted in the vending machine spaced from and parallel to each other and extend along respective first and second axes. The carriage rail extends along a third axis and includes first and second ends that are slidably connected to the respective ones of the first and second guide rails. A carrier member is slidably mounted to the carriage rail for movement along the third axis. A first drive belt is coupled to the carriage rail and a first drive motor to selectively shift the carrier member along the third axis. A second drive belt, extending in multiple axes, is connected to each of the first and second ends of the carriage rail and a second drive motor. The second drive motor selectively shifts the carriage rail along the first and second axes upon driving the second drive belt.

20 Claims, 7 Drawing Sheets

U.S. PATENT DOCUMENTS 5,467,892 A * 11/1995 Schlamp ..... 221/7
5,476,358 A * 12/1995 Costa ..... 414/749.1
5,497,905 A 3/1996 Vogelpohl et al.
5,505,332 A 4/1996 Vogelpohl et al.
5,651,476 A 7/1997 Percy et al.
5,791,516 A * 8/1998 Wittern et al. ..... 221/301
5,813,817 A * 9/1998 Matsumiya et al. ..... 414/280
5,927,539 A 7/1999 Truitt et al.
6,098,841 A 8/2000 Katakai
6,199,720 B1 3/2001 Rudick et al.
6,230,930 B1 5/2001 Sorensen et al.
6,253,954 B1 7/2001 Yasaka
6,286,715 B1 9/2001 Ziesel et al.
6,315,157 B1 * 11/2001 Halliburton ..... 221/87
6,315,384 B1 * 11/2001 Ramaswami et al. ..... 347/20
6,328,180 B1 * 12/2001 Sorensen et al. ..... 221/131
6,352,174 B1 3/2002 Bauman et al.
6,354,098 B1 3/2002 Bardin et al.
6,415,952 B1 7/2002 Ohtuka et al.
6,415,953 B1 7/2002 O'Brien et al.
6,499,627 B2 12/2002 Arai
6,513,677 B1 2/2003 Sorensen et al.
6,520,604 B1 2/2003 Yasakka et al.
6,550,269 B2 4/2003 Rudick
6,556,889 B2 4/2003 Rudick et al.
6,564,964 B2 5/2003 Johnson
6,571,988 B2 6/2003 Bowen
6,582,037 B1 6/2003 Rudick et al.
6,755,322 B1 * 6/2004 Herzog et al. ..... 221/123
6,962,267 B2 11/2005 Herzog et al.
2001/0000609 A1 * 5/2001 Rudick et al. ..... 221/6
2001/0000610 A1 5/2001 Johnson
2001/0048000 A1 12/2001 Arai
2003/0006241 A1 * 1/2003 Johnson ..... 221/75
2003/0201275 A1 10/2003 Tamura
2004/0056042 A1 * 3/2004 Skavnak ..... 221/289
2005/0082309 A1 4/2005 Holdway et al.

FOREIGN PATENT DOCUMENTS

JP 402148388 A 6/1990
JP 410302139 A 11/1998
JP 411213225 A 8/1999
JP 411353546 A 12/1999
JP 411353547 A 12/1999
JP 2000030140 A 1/2000
JP 2000105869 A 4/2000
JP 2001134828 A 5/2001
JP 2002056446 A 2/2002
JP 2002074493 A 3/2002
JP 2002092712 A 3/2002
JP 2002150396 A 5/2002

* cited by examiner

PRODUCT TRANSPORT SYSTEM FOR A VENDING MACHINE

BACKGROUND OF THE INVENTION

1. Field of the Invention

The present invention pertains to the art of vending machines and, more particularly, to a transport system that shifts along multiple axes to carry a selected product from a display/storage area to a dispensing area for delivery to a consumer.

2. Discussion of the Prior Art

Vending machines for dispensing canned and/or bottled beverages have long been known. Early model vending machines release similarly sized bottles, one at a time, following deposit of the required purchase amount. In order to withdraw the selected bottle from the vending machine, the purchaser was required to, for example, manually remove a beverage container through a release mechanism on a shelf. Over time, manufacturers developed various other mechanisms for releasing products from vending machines. These arrangements range from a more conventional mechanism wherein the products are guided within a chute, often times along a serpentine path, into a delivery port, to more unique mechanisms such as the use of transport systems that shift a product transport carrier to a point adjacent a selected product, receive the selected product and then deliver the selected product to the consumer.

The more unique mechanisms are gradually becoming more prevalent, particularly given their ability to attract consumers. That is, the ability to watch the selected product being transported about the vending machine has proven to be an attraction to many consumers, often times convincing the consumer into making a purchase. Unfortunately, while the more unique mechanisms have proven successful at attracting customers, often times the more unique mechanisms are generally more complex, costly and prone to potential operational problems.

Many of the more unique transport systems employ linear actuator mechanisms having a vertical rail slidably mounted to upper and lower horizontal rails. A carrier is mounted to the vertical rail for movement between product shelves. Typically, a motor is mounted to the vertical rail for driving a belt in order to shift the carrier. The vertical rail is shifted along the horizontal rails to position the carrier adjacent a particular product. In general, horizontal translation of the vertical rail is accomplished by synchronized operation of distinct upper and lower drive motors. The drive motors are connected to upper and lower drive belts which are, in turn, connected to end portions of the vertical rail. While this method is generally effective at positioning the carrier, it is often difficult to maintain proper synchronization between the upper and lower drive motors. That is, through continued use, components of the upper and lower drive motors will wear causing one motor to operate at a rate different that the other motor resulting in misalignment of the carrier with the particular product. In addition to problems associated with maintaining a desired synchronization between multiple motors, maintaining proper tension in multiple drive belts has also proven to be a challenge. That is, like the drive motors, through continuous use, the drive belts will wear at different rates. One belt will, over time, stretch more than the other. Unless proper and similar tensions are maintained in both of the belts, the carrier may not be properly positioned.

Based on the above, despite the presence of numerous types of product transport systems in the prior art, there still exists a need for an enhanced, belt driven product transport system for a vending machine. More specifically, there exists a need for a product transport system that eliminates the need to synchronize motors, while also avoiding the problems associated with varying belt tension.

SUMMARY OF THE INVENTION

The present invention is directed to a vending machine including a product delivery system that shifts along multiple axes inside a cabinet to transport a selected product from one of a plurality of product queues, arranged on one of a plurality of product shelves, to a dispensing chamber for delivery to a consumer. In accordance with the invention, the product delivery system includes first and second guide rails and a carriage rail. Each of the first and second guide rails are fixedly mounted in the cabinet. The guide rails are spaced from one another and extend along a first and second substantially parallel axes. The carriage rail extends across the cabinet along a third axis and is slidably mounted to the first and second guide rails. More specifically, the carriage rail includes a first end connected to the first guide rail and a second end connected to the second guide rail. A carrier member is slidably mounted to the carriage rail for movement along the third axis.

In accordance with the invention, the product transport system includes a first drive belt associated with movement along the third axis. The first drive belt is mounted to the carriage rail and operatively coupled to the carrier member. The first drive belt is also operatively connected to a first drive motor which is selectively activated to shift the carrier member along the carriage rail. During a vend operation, the motor shifts the carrier member along the carriage rail to a position adjacent a particular product. However, in addition to translation along the third axis, the carriage rail member must be shifted along the first and second axes.

In accordance with the most preferred form of the invention, the product delivery system includes a second, continuous drive belt associated with movement along the first and second axes. The second drive belt includes a first portion that extends adjacent the first guide rail and which is operatively connected to the first end of the carriage rail; a second, intermediate portion that extends substantially parallel to the third axis; and a third portion that extends adjacent the second guide rail and which is operatively connected to the second end of the carriage rail. The second drive belt is operatively connected to a second drive motor that is fixedly mounted relative to the cabinet. The second drive motor is selectively activated to shift the carriage rail along the first and second axes to position the carrier member adjacent the particular product. That is, the first and second drive motors shift the carrier member along X and Y axes to a point adjacent the selected product. In any event, the above described construction advantageously provides movement of the carrier member along multiple axes without the need to synchronize drive motors or to match tensions in drive belts.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
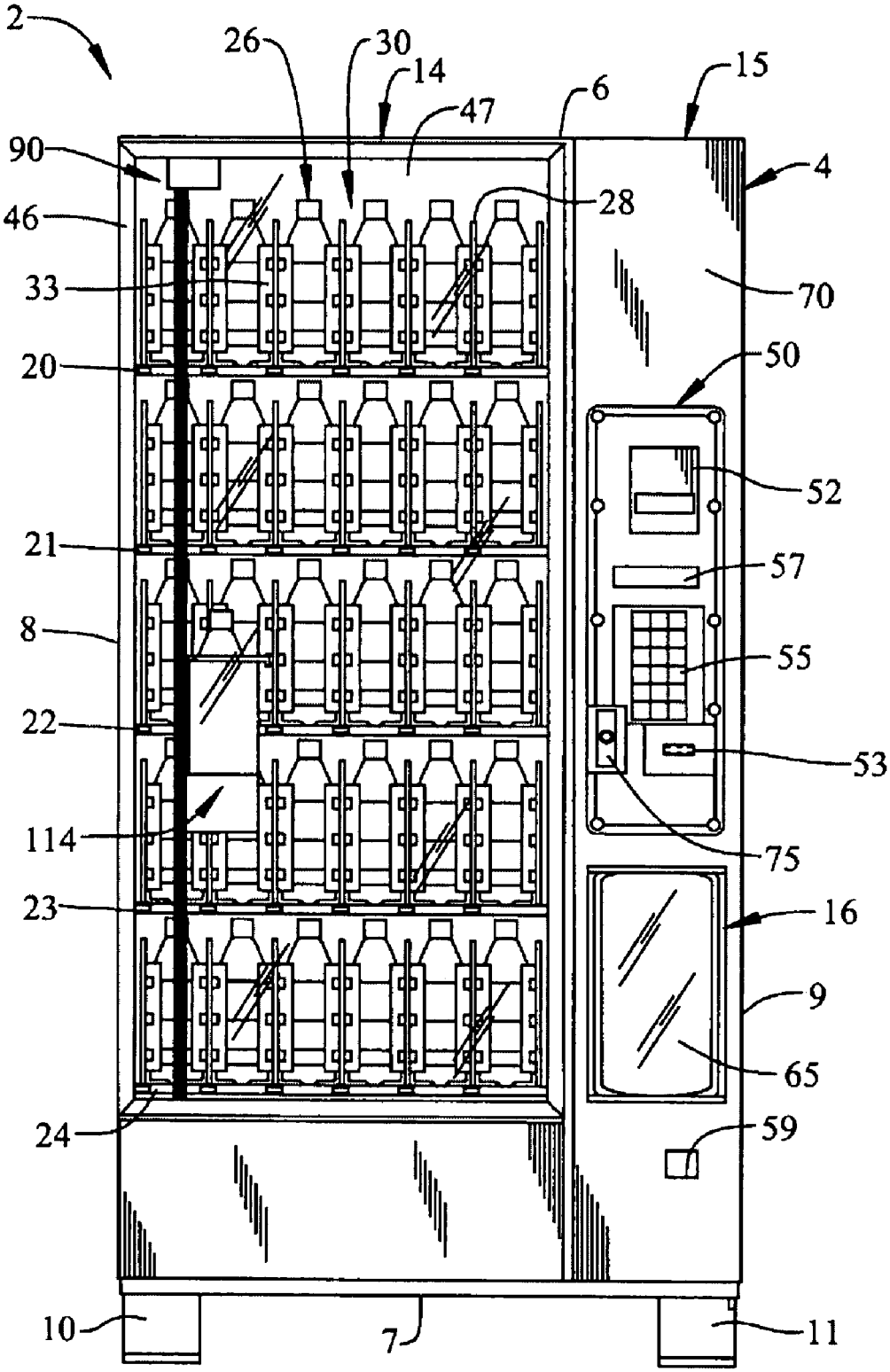
FIG. 1 is a front elevational view of a vending machine constructed in accordance with the present invention.
Figure 2:
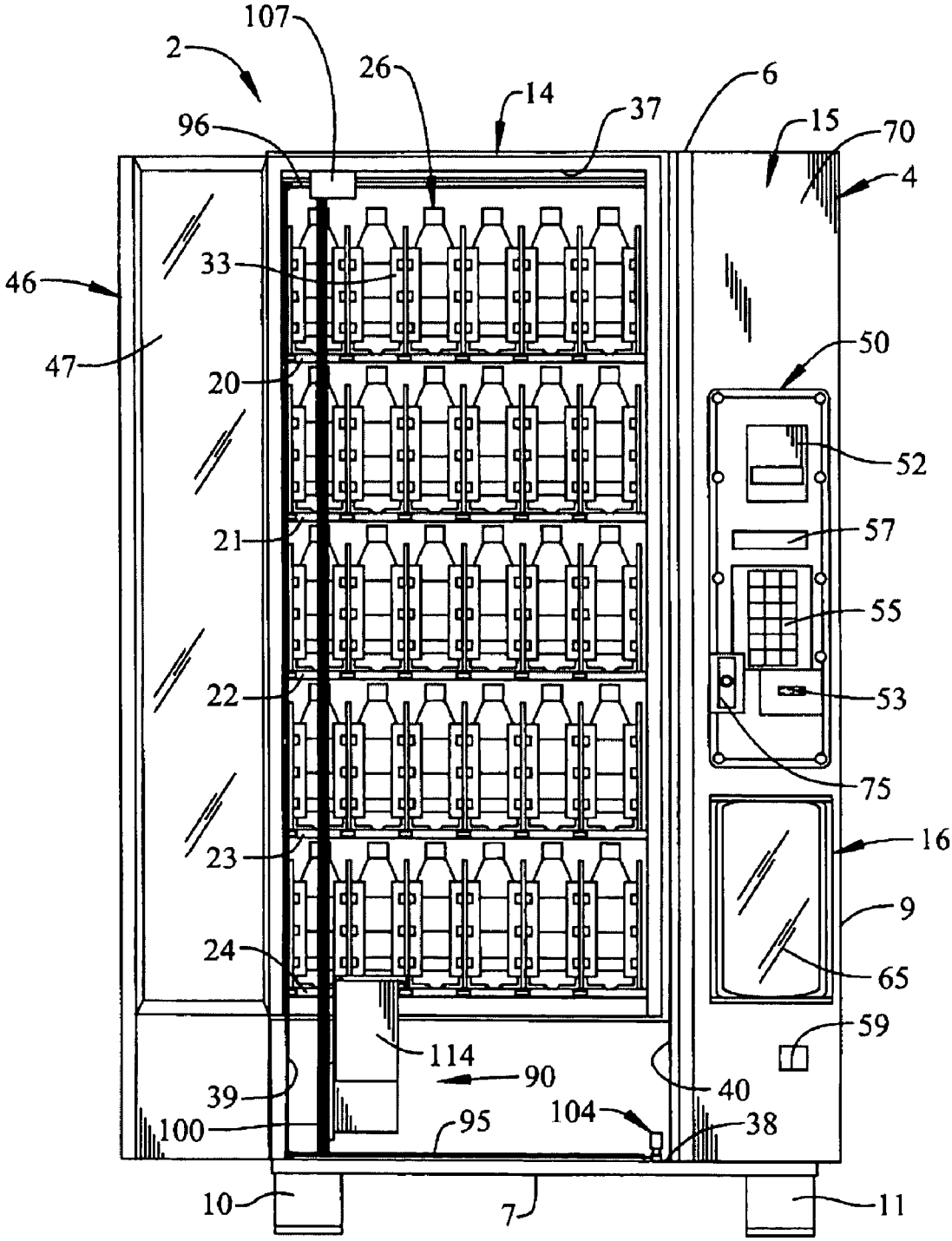
FIG. 2 is an elevational view of the vending machine of FIG. 1 with the door of a product storage zone shown open.

With initial reference to FIGS. 1 and 2, a vending machine generally indicated at 2 includes a cabinet 4. As shown, cabinet 4 includes top, bottom and opposing side walls 6-9. Arranged below bottom wall 7 are various leg members 10 and 11 for positioning vending machine 2 upon a supporting surface (not shown). In the preferred embodiment shown, vending machine 2 is divided into a plurality of zones, with each zone being associated with a particular portion of a vending operation. Towards that end, vending machine 2 includes a storage and display zone 14, a currency receiving zone 15 and a dispensing zone 16.

As illustrated, storage/display zone 14 is provided with a plurality of product support shelves 20-24 for supporting and displaying a plurality of product containers, one of which is indicated at 26. Each of the plurality of product support shelves 20-24 includes a plurality of dividers, one of which is indicated at 28, that establish a plurality of product queues, one of which is indicated at 30 on product support shelf 20. Each of the plurality of product queues 30 includes an associated dispensing or escapement mechanism 33 for releasing a product container 26 from storage/display zone 14 for delivery to a consumer. The actual construction and operation of dispensing mechanism 33 does not constitute part of the present invention. Instead, various known dispensing mechanisms could be employed, including that set forth in detail in commonly assigned U.S. Pat. No. 6,571,988 entitled "Article Release Mechanism For a Vending Machine" issued on Jun. 3, 2003. In a manner known in the art, storage/display zone 14 includes top, bottom and opposing side walls 37-40 (see FIG. 2) and is provided with a door 46 having a glass panel 47 to enable a consumer to view and choose between the variety of product containers 26 carried within vending machine 2.

Arranged alongside storage/display zone 14 is currency receiving zone 15. In the embodiment shown, currency receiving zone 15 includes a currency receiving center 50 for inputting currency deposited by the consumer during a vend transaction. Currency receiving center 50 includes a bill acceptor/validator 52, a multi-price coin mechanism 53 and a key pad 55 for inputting particular product selections. Currency receiving center 50 also includes a display 57 for providing information to the consumer, as well as validating the particular selection made. Finally, a coin return slot 59 is provided for returning any required change to the consumer at the completion of a vend operation. Arranged below currency receiving zone 15, dispensing zone 16 includes a dispensing chamber 65 that enables a consumer to remove a dispensed product from vending machine 2. In the embodiment shown, currency receiving zone 15 and dispensing zone 16 are provided on a door 70 that overlaps door 46 and therefore must be opened prior to opening door 46. To this end, door 70 is preferably provided with a lock 75 that prevents unauthorized access to within vending machine 2.

In accordance with the invention, vending machine 2 includes a product transport and delivery system 90 that receives one of the plurality of product containers 26 from one of the plurality of product queues 30 and transports the selected product towards delivery chamber 65 for receipt by the consumer. As referenced in FIG. 2, product transport system 90 includes a first, laterally extending guide rail 95 arranged on lower wall 38 of product storage zone 14, a second, laterally extending guide rail 96 arranged on upper wall 37 and an upstanding carriage rail 100 that extends across storage/delivery zone 14 between first and second guide rails 95 and 96. Product transport system 90 also includes a first or horizontal axis translation mechanism 104 for shifting carriage rail 100 between the plurality of product queues 30 and a second or vertical axis translation mechanism 107 that selectively shifts a product delivery cup 114, that is slidably supported by carriage rail 100, between the plurality of product shelves 20-24. In any case, product transport system 90 shifts product delivery cup 114 along multiple axes to receive and transport a selected product container 26 from one of the plurality of product queues 30 towards dispensing chamber 65 in a manner that will be detailed more fully below.

Reference will now be made to FIGS. 3-6 in describing particular details of product transport system 90. In the preferred embodiment shown, guide rail 95 includes a first end 140, a second end 141 and an intermediate portion 142. Guide rail 95 is secured to bottom wall 38 through a plurality of mechanical fasteners 145*a-c*. Likewise, second guide rail 96 is fixed to top wall 37 and includes a first end 148 that extends to a second end (not shown) through an intermediate portion 150. As shown, first and second guide rails 95 and 96 extend along first and second generally horizontal axes within product storage and delivery zone 14.

As further shown in the figures, carriage rail 100, which extends along a third or vertical axis, includes a first end 160 leading to a second end 161 through an intermediate portion 162. First end 160 is slidingly mounted to first guide rail 95 and second end 161, in a similar manner, is slidingly mounted to second guide rail 96. Carriage rail 100 supports a carrier member 168, to which product delivery cup 114 is secured, that shifts vertically along carriage rail 100 to position product delivery cup 114 at a select one of the plurality shelves 20-24. More specifically, carrier member 168 includes a plurality of rollers two of which are indicated at 180 and 181 in FIG. 5. Rollers 180 and 181 are secured to carrier member 168 through a pair of fasteners 184*a* and 184*b*. A second plurality of fasteners 184*c*-184*d* support an opposing pair of rollers (not shown). Each roller. 180, 181 includes a radial groove that rides along an outer edge portion (not separately labeled) of carriage rail 100 as carrier member 168 transitions along the third axis defined by carriage rail 100.

Figure 4:
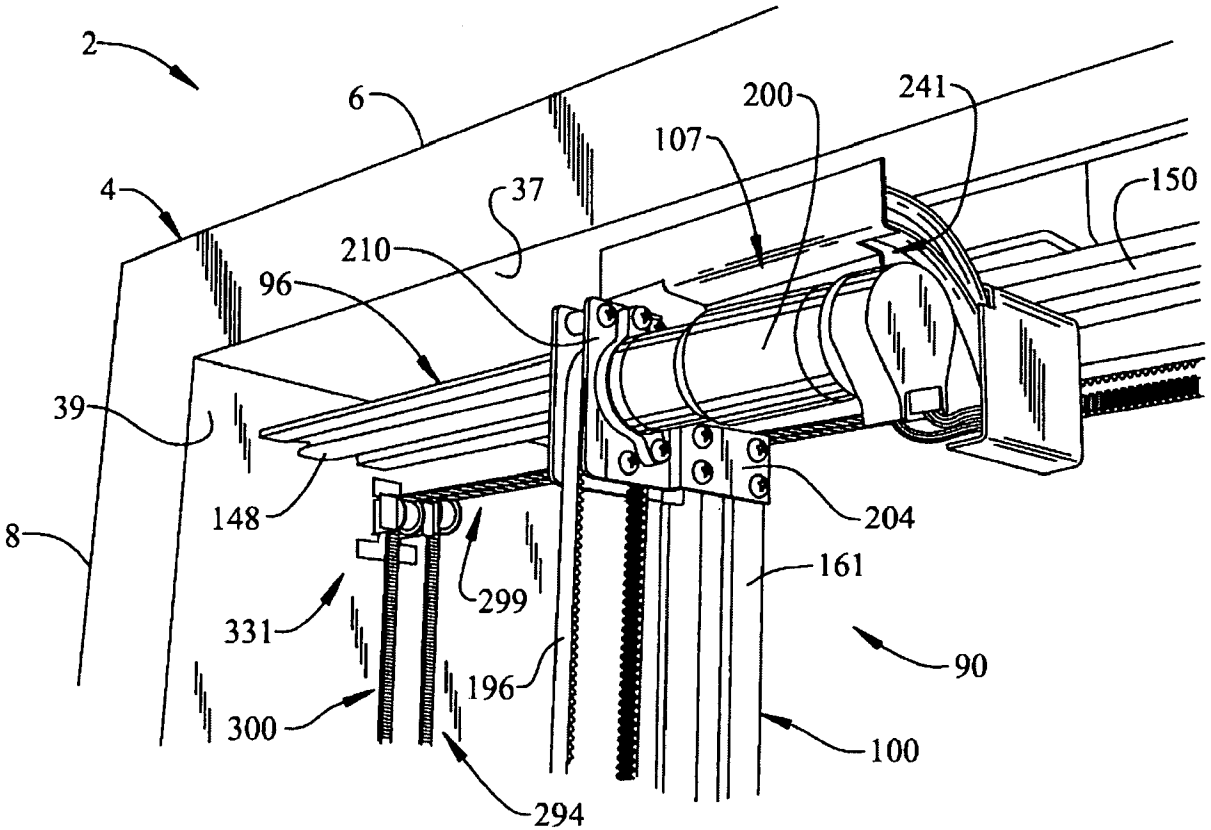
FIG. 4 is a perspective view of an upper portion of the product transport system incorporated in the vending machine of FIGS. 1 and 2.

In accordance with the invention, a first drive belt 196 extends between first and second ends 160 and 161 of carriage rail 100. Preferably, first drive belt 196 constitutes a continuous belt and is operatively connected to a vertical translation mechanism 107 which, in the embodiment shown, is constituted by a motor 200. At this point, it should be understood that by "continuous" it is meant that belt 196 forms a loop. That is, while belt 196 could be formed as one continuous element, end portions of belt 196 could also be joined, such as through a mechanical device such as a clamp, to form a continuous loop. In any case, as best shown in FIG. 4, motor 200 is connected to second end 161 of carriage rail 100 through a bracket 204. Motor 200 includes an upper pulley (not shown) that establishes a first or upper limit of belt 196. The upper pulley is mounted within a pulley housing 210 which, in the embodiment shown, is formed as part of bracket 204. At a lower limit, belt 196 extends about a lower pulley 215 (see FIG. 5) that is supported by a bracket 217 provided at first end 160 of carriage rail 100. Belt 196 includes a section (not labeled) that is clamped to carrier member 168 such that carrier member 168 shifts vertically with movement of belt 196. More particularly, motor 200 is selectively activated to shift carrier member 168 and product delivery cup 114 along carriage rail 100.

Figure 5:
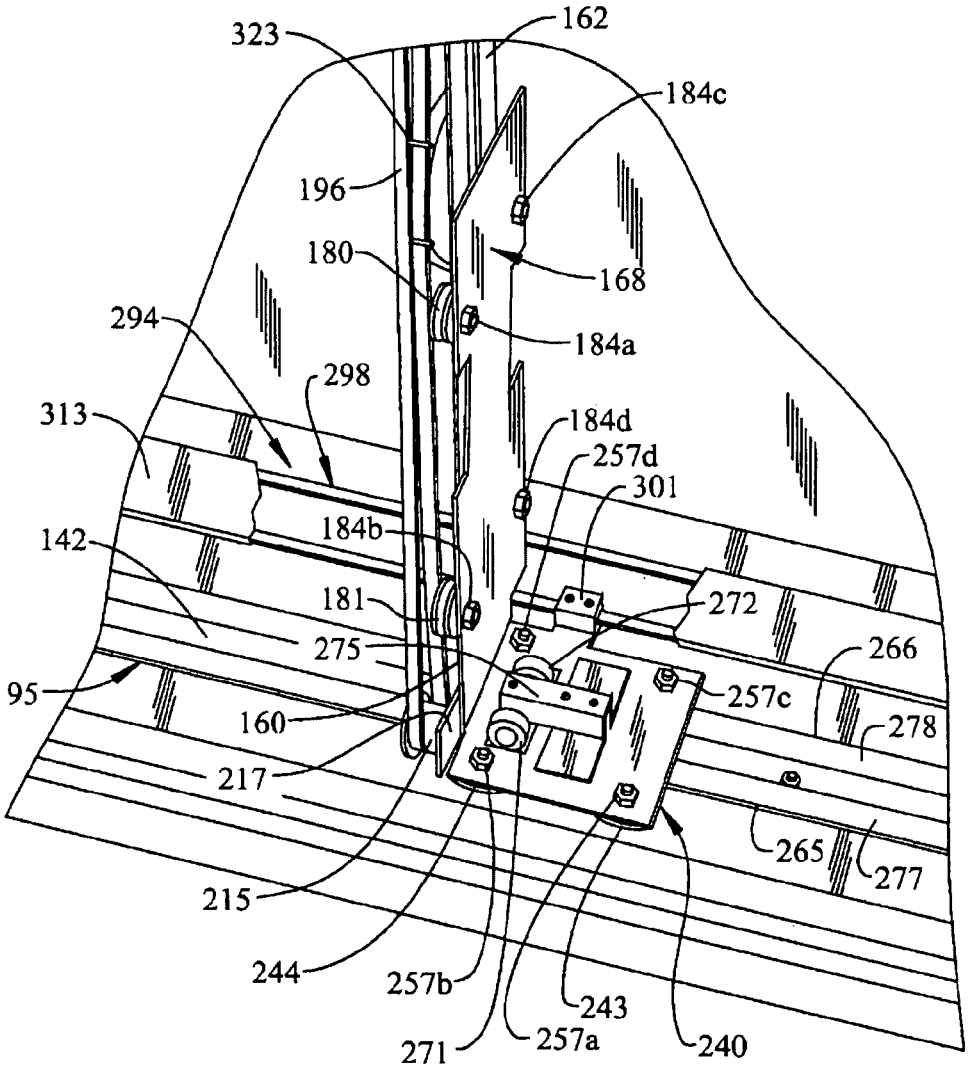
FIG. 5 is an enlarged perspective view of the lower portion of the product transport system of FIG. 3 with a delivery cup unit removed.
Figure 6:
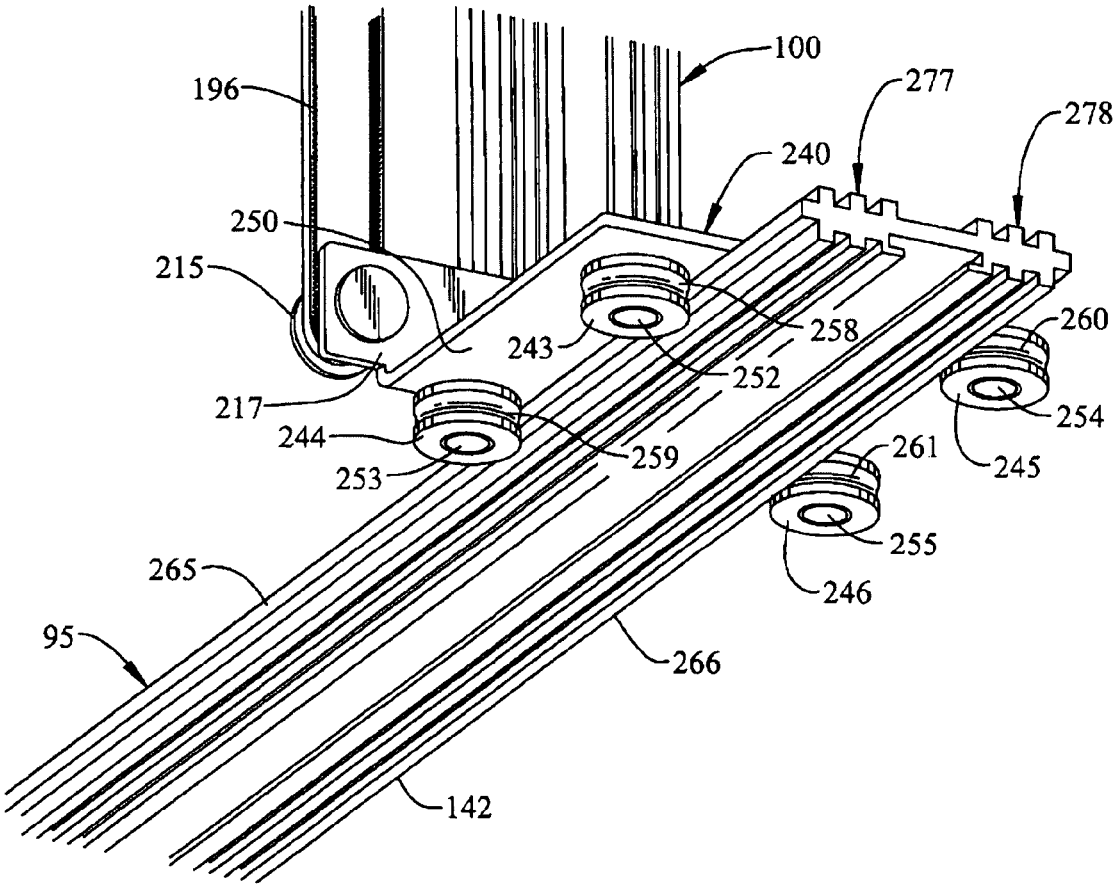
FIG. 6 is a perspective view of a guide rail arrangement employed with the product transport system.

In accordance with the most preferred form of the invention, carriage rail 100 is connected to first and second guide rails 95 and 96 through a pair of roller plates 240 and 241. However, as each roller plate 240, 241 is similar, a detailed description will be made with respect to roller plate 240 with an understanding that roller plate 241 is substantially similarly constructed. As best shown in FIGS. 5 and 6, roller plate 240 includes a first plurality of rollers 243-246 that are rotatably supported from a bottom portion 250 of roller plate 240 through a respective plurality of pins 252-255 which, in turn, are secured to roller plate 240 through a plurality of mechanical fasteners 257*a*-257*d*. As shown, each of the first plurality of rollers 243-246 include a respective radial groove 258-261 that facilitates travel along outer edge portions 265 and 266 of guide rail 95. Roller plate 240 is also provided with a second plurality of rollers 271 and 272 that are rotatably carried by a support portion 275 of roller plate 240. Second plurality of rollers 271 and 272 travel along exposed surface portions 277 and 278 of guide rail 95. With this construction, first and second plurality of rollers 243-246 and 271, 272 facilitate a smooth translation along the first axis for first end 160 of carriage rail 100 in a manner that will be detailed more fully below.

Figure 3:
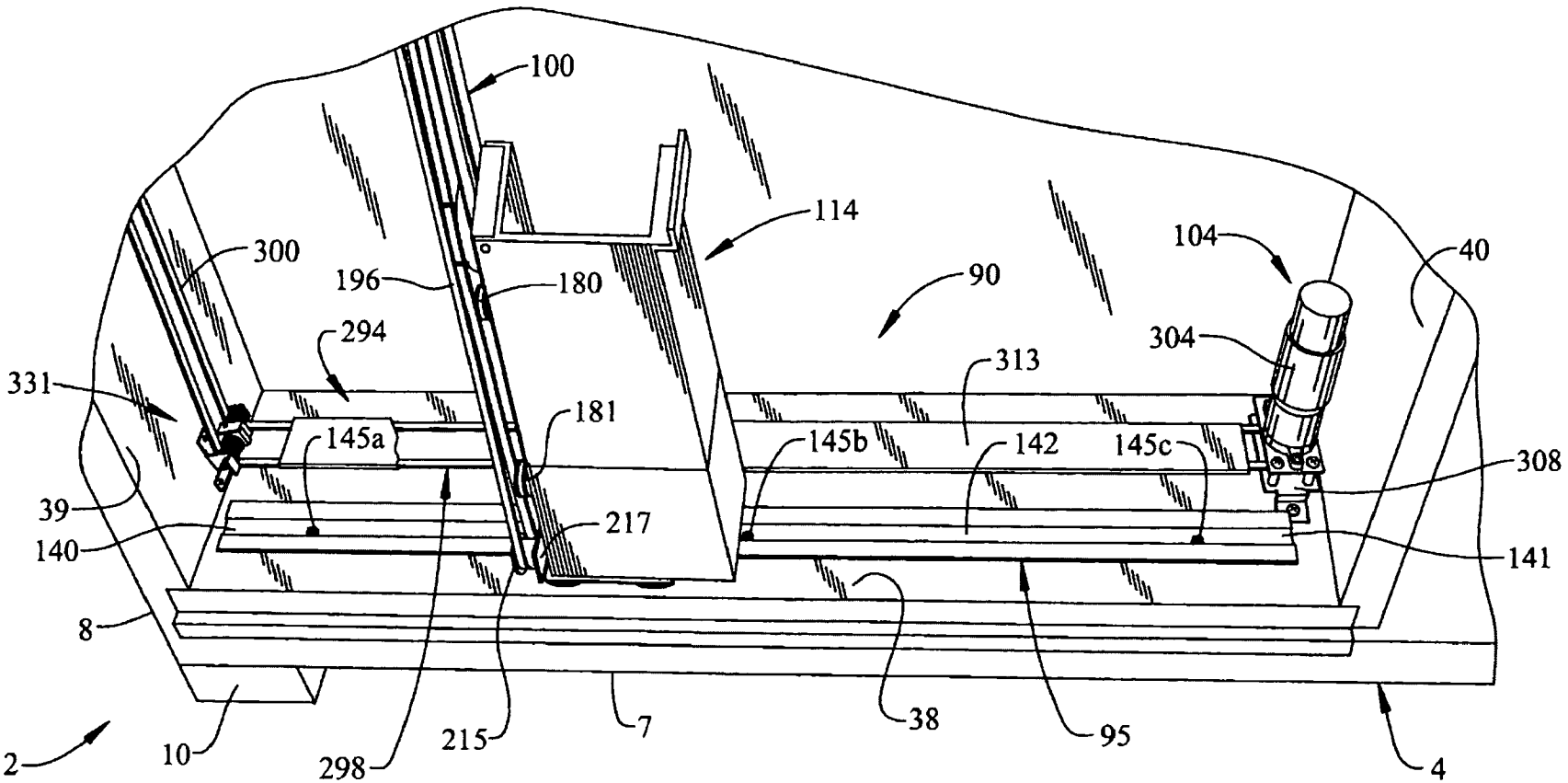
FIG. 3 is a perspective view of a lower portion of a product transport system incorporated in the vending machine of FIGS. 1 and 2.

In further accordance with the most preferred form of the invention, product transport system 90 includes a second, continuous drive belt 294 having a first portion 298 that extends along first guide rail 95 along the first axis, a second portion 299 that extends along second guide rail 96 along the second axis, and an intermediate portion 300 which extends along side wall 39. As best shown in FIGS. 3 and 4, first portion 298 transitions to intermediate portion 300 on a junction of bottom wall 38 and side wall 39. Intermediate portion 300 then extends along the third axis until transitioning to second portion 299 at a junction of side wall 39 and top wall 37. Second drive belt 294 is operatively connected to horizontal translation mechanism 104 which includes a drive motor 304. Drive motor 304 includes a pulley (now shown) provided within a pulley housing 308. With this arrangement, a single drive source can provide movement along both the first and second axes. That is, first and second roller plates 240 and 241 are connected to second drive belt 294 through, for example, a bracket 301 as shown in FIG. 5. Actually, in order to ensure proper operation of carriage rail 100, roller plate 240 is connected to a first section (not separately labeled) of drive belt 294 while, second roller plate 241 is connected to a second section (not labeled). Motor 304 is selectively operated to shift carriage rail 100 along the first and second axes defined by first and second guide rails 95 and 96.

As also shown in these figures, a lower cover 313 is provided over second drive belt 294 along bottom wall 38 to prevent foreign objects from interfering with the operation of product transport and delivery system 90. In any case, while only a single cover 313 is shown, it should be understood that substantially all exposed portions of drive belt 294 could be covered. Likewise, first drive belt 196 is also preferably covered, however this structure has been removed in the figures to enable a better understanding of the overall system construction.

Figure 7A:
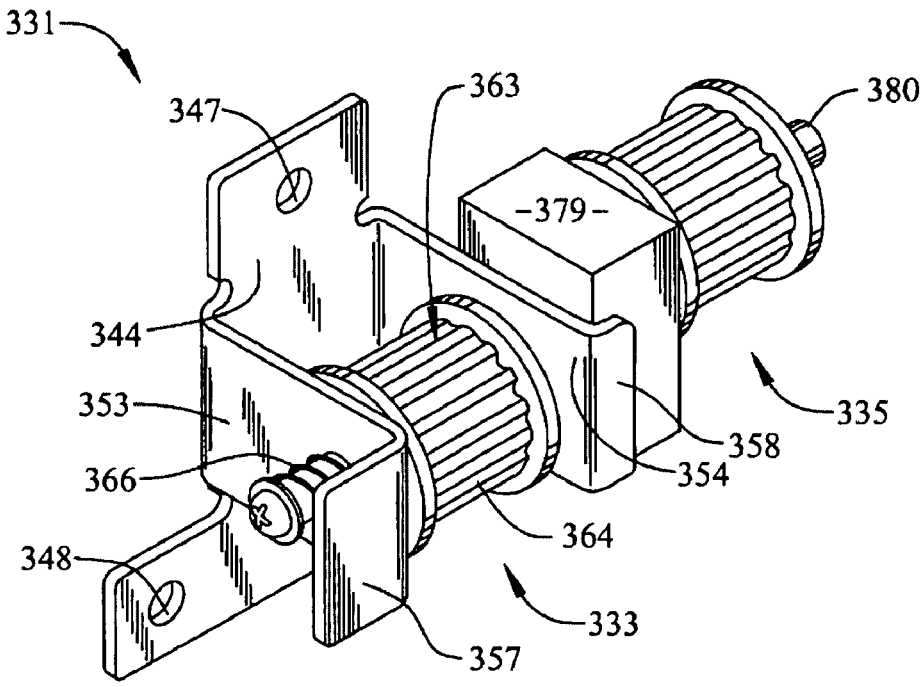
FIG. 7A is a perspective view of a belt tensioning mechanism employed in connection with a preferred embodiment of the invention shown in a tension release or belt loading position.
Figure 7B:
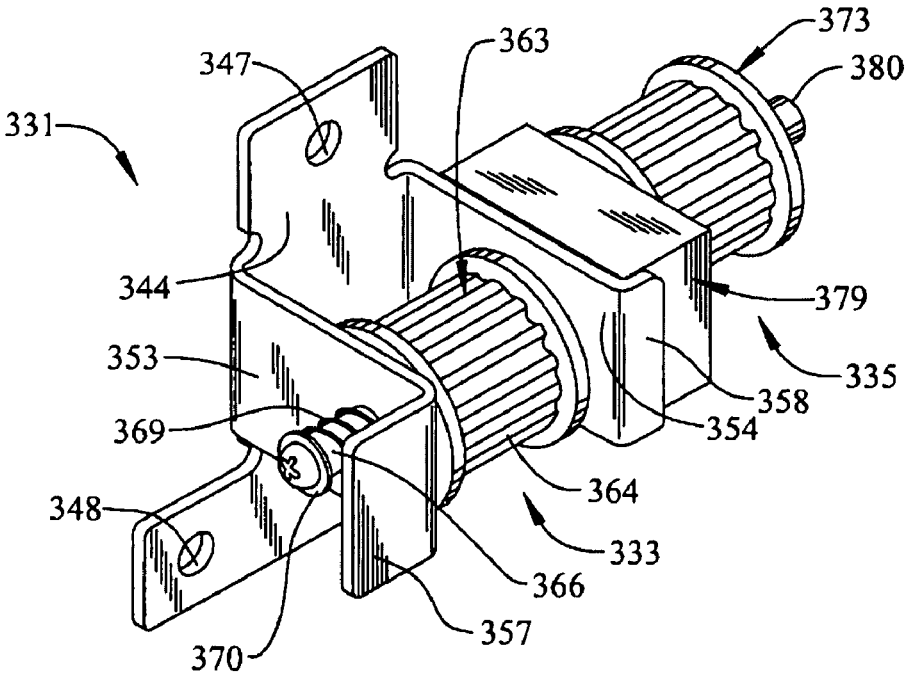
FIG. 7B is a perspective view of the belt tensioning mechanism of FIG. 7A shown in an in-use or tensioning position.

In order to ensure proper operation of product transport system 90, each drive belt 196, 294 is preferably provided with a belt tensioning device which, in accordance with one aspect of the invention, is constituted by a spring clip member 323 shown in connection with drive belt 196 in FIG. 5. Spring clip member 323 provides tension to ensure proper engagement between drive belt 196 and pulley 215, as well as drive motor 200. In accordance with another aspect of the invention, the belt tensioning device is constituted by a spring loaded idler pulley, one of which is shown at 331 in FIG. 3 arranged at the transition of belt 294 from bottom wall 38 to side wall 39 and another of which is shown in FIG. 4 at the transition of belt 294 from side wall 39 to top wall 37. As will become more evident below, the upper and lower spring loaded idler pulleys 331 are identically constructed, but reversed in mounting to provide tensioning to both legs of belt 294. As best shown in FIGS. 7A and 7B, spring loaded idler pulley 331 includes a first or stationary pulley unit 333 that receives one section of second drive belt 294, as well as a second, shiftable pulley unit 335 that receives a second portion of second drive belt 294. In particular, pulley unit 335 can transition between a first position, as shown in FIG. 7A for receiving second drive belt 294, to a second position, as shown in FIG. 7B, that places tension on second drive belt 294 in a manner that will be discussed more fully bellow.

Spring loaded idler pulley 331 includes a bracket 344 having a plurality of mounting apertures, two of which are shown at 347 and 348, for attaching spring loaded idler pulley to, preferably, side wall 39. Bracket 344 includes first and second leg portions 353 and 354, each having a corresponding outturned face section 357, 358. Arranged between first and second leg portions 353 and 354 is a first pulley 363 having a plurality of ridges 364 for receiving corresponding teeth arranged on drive belt 294. In any case, first pulley 363 is supported upon a pin 366 that is loaded by a spring 369 compressed between leg portion 353 and a washer 370. First pulley 363 constitutes the stationary portion of spring loaded idler pulley 331. By stationary portion, it should be understood to mean that, while first pulley 363 can rotate freely, and axis of rotation of first pulley 363 is fixed.

Spring loaded idler pulley 331 also includes a second pulley 373 that is rotatably supported by a block member 379 through a pin 380. Block member 379 is mounted on pin 366, which extends through second leg 354 of bracket 344. Pin 380 is preferably, axially offset from pin 366. With this arrangement, block member 379 can be shifted laterally outward against a force supplied by spring 369 and pivoted about an axis defined by pin 366 such that block member 379 can be rotated relative to bracket 344. With this arrangement, pin 380 and pulley 373 can be shifted to a forward position, such as shown in FIG. 7A. In this particular orientation, belt 294 can be readily placed about second pulley 373. Once belt 294 is in place, block 379 is then rotated back about the axis defined by pin 366 to the position shown in FIG. 7B wherein second pulley 373 is offset from first pulley 363. In this manner, a tension is provided on belt 294 to ensure proper operation of product transport delivery system 90.

At this point, is should be understood that the product transport and delivery system constructed in accordance with the present invention provides a rather advantageous arrangement employing a single drive motor to shift a product delivery cup along a first axis and another, single drive motor to shift the product delivery cup along a second axis. That is, by utilizing only a single motor for movement in each axis, the need to provide synchronization between multiple motors is no longer necessary. Particularly advantageous is the generally C or U-shaped arrangement for one continuous drive belt which enables both ends of a carriage or other product transport unit to be positively driven for movement in one directional axis with a single, preferably fixed, drive motor. In addition, by utilizing a single drive belt in connection with each motor, problems associated with improper tensioning or stretching of one belt more than another is also removed, ensuring that product delivery cup 114 is properly positioned even after extended operation of vending machine 2. Furthermore, motors 200 and 304 drive belts 196 and 294 through their respective drive pulleys, with the drive pulleys being mounted between bushings (not shown). In this manner, side loads are not placed on the driveshafts of motors 200 and 304. With this construction, motors 200 and 304 can be disconnected from their respective pulley without removing the associated belt 196, 294.

Although described with reference to a preferred embodiment of the invention, it should be readily understood that various changes and/or modifications can be made to the invention without departing from the spirit thereof. For instance, while described with reference to horizontal and vertical axes, the axes can also be reversed without detracting from the operation of the product delivery system. That is, the continuous belt in the described embodiment is used in connection with horizontal or X-axis shifting, while the arrangement could be readily re-aligned for use in connection with a controlled vertical or Y-axis shifting design such as would be needed if the transport system employed a conveyor in place of the delivery cup described. To that end, it should also be noted that various mechanisms could be employed to carry the selected product towards the delivery chamber. In addition, various guide configurations could also be employed for the carriage, including a sleeve shiftably mounted for movement along a guide shaft. In general, the invention is only intended to be limited by the scope of the following claims.

We claim:

1. A vending machine comprising:

a cabinet;

a product storage zone arranged within the cabinet;

a plurality of shelves arranged within the product storage zone, each of the plurality of shelves including a plurality of dividers that establish a plurality of product queues;

a dispensing chamber arranged within the cabinet, the dispensing chamber including an access opening that provides access to a dispensed product; and a product delivery mechanism that shifts, along multiple axes, to transport a selected product from one of the plurality of products queues towards the dispensing chamber, the product delivery mechanism including:

first and second guide rails fixedly mounted relative to the cabinet and extending along first and second spaced, substantially parallel axes;

a carriage rail extending across the cabinet along a third axis, the carriage rail including a first end portion slidably connected to the first guide rail extending to a second end portion slidably connected to the second guide rail, the first end portion including first and second pairs of grooved rollers on opposite sides of the first guide rail and spaced apart along a length of the first guide rail, the second end portion including third and fourth pairs of grooved rollers on opposite sides of the second guide rail and spaced apart along a length of the second guide rail, wherein circumferential grooves on each of the rollers receives an edge of the first or second guide rail;

a carrier member mounted for relative movement along the carriage rail;

a first drive belt mounted to the carriage rail, the first drive belt being operatively connected to the carrier member;

a first drive motor supported by the carriage rail and operatively connected to the first drive belt, the first drive motor being selectively activated to shift the carrier member relative to the carriage rail along the third axis;

a second drive belt mounted in the cabinet, the second drive belt being continuous and including a first portion operatively connected to the first end portion of the carriage rail and extending along a portion of the length of the first guide rail separating the carriage rail from a first end of the first guide rail, substantially parallel to the third axis between the first and second guide rails, along the second guide rail from a first end to a second end of the second guide rail, and along a portion of the length of the second guide rail separating the carriage rail from the second end of the second guide rail, the second drive belt also including a second portion operatively connected to the second end portion of the carriage rail and extending along a portion of the length of the second guide rail separating the carriage rail from a second end of the second guide rail, substantially parallel to the third axis between the first and second guide rails, along the first guide rail from a first end to a second end of the first guide rail, and along a portion of the length of the first guide rail separating the carriage rail from the second end of the first guide rail; and a second drive motor fixedly mounted relative to the cabinet and operatively connected to the second drive belt, the second drive motor being selectively operated to shift the carriage relative to the first and second guide rails along the first and second axes, wherein the first and second drive motors combine to position the carrier member adjacent one of the plurality of product queues corresponding to the selected product, wherein the carrier member carries the selected product towards the dispensing chamber.

2. The vending machine according to claim 1, further comprising:

first and second roller plates, the first and second roller plates being mounted to corresponding ones of the first and second ends of the carriage rail, with each of the first and second roller plates including the first and second pairs of grooved rollers and the third and fourth pairs of grooved rollers, respectively.

3. The vending machine according to claim 2, wherein the rollers constitute a plurality of guide rollers and a plurality of support rollers.

4. The vending machine according to claim 3, wherein each of the rollers includes a smooth surface adapted to ride against an exposed surface portion of a respective one of the first and second guide rails.

5. The vending machine according to claim 2, wherein each of the first and second roller plates includes a mounting member, the mounting member being fixedly attached to the second drive belt.

6. The vending machine according to claim 1, further comprising:

a belt tensioning device acting upon the second drive belt to maintain a desired belt tension.

7. The vending machine according to claim 6, wherein the belt tensioning device is constituted by spring member.

8. The vending machine according to claim 6, wherein the belt tensioning device is constituted by a spring loaded idler pulley assembly fixedly mounted in the cabinet.

9. The vending machine according to claim 8, wherein the product storage zone including a top wall, a bottom wall and opposing side walls, the belt tensioning device being constituted by first and second spring loaded idler pulley assemblies, the first spring loaded idler pulley assembly being mounted on one of the opposing side walls adjacent the bottom wall and the second spring loaded idler pulley assembly being mounted on the one opposing side wall adjacent the top wall.

10. The vending machine according to claim 1, further comprising:

a product delivery cup mounted to the carrier member, the product delivery cup being adapted to transport a selected product from the one of the plurality of product queues to the dispensing chamber for delivery to a consumer.

11. The vending machine according to claim 1, further comprising:

a plurality of cover plates extending across at least one of the first and second drive belts to preventing foreign objects from interfering with movement of the product delivery mechanism.

12. The vending machine according to claim 1, wherein the first axis extends along a substantially horizontal axis and the third axis extends along a substantially vertical axis.

13. The vending machine according to claim 1, wherein the first drive belt also constitutes a continuous drive belt.

14. A vending machine comprising:

a cabinet;

a product storage zone arranged within the cabinet;

a plurality of shelves arranged within the product storage zone, each of the plurality of shelves including a plurality of dividers that establish a plurality of product queues;

a dispensing chamber arranged within the cabinet, the dispensing chamber including an access opening that provides access to a dispensed product; and a product delivery mechanism that shifts to transport a selected product from one of the plurality of products queues towards the dispensing chamber, the product delivery mechanism including:

a product transporting unit;

a continuous drive belt mounted in the cabinet and connected to the product transporting unit such that movement of the continuous drive belt causes shifting of the product transporting unit, the continuous drive belt including a first portion extending from a member supporting the product transporting unit along a first axis to a first end of a guide member along which the member supporting the product transporting unit travels, a second portion extending along a second axis for a length of a second guide member along which the member supporting the product transporting unit travels and from a second end of the second guide member along the second axis to the member supporting the product transporting unit, and a third portion extending along a third axis between the first and second guide members, the continuous drive belt further including a fourth portion extending from the member supporting the product transporting unit along the second axis to a first end of the second guide member, a fifth portion extending along a length of the first guide member and from a second end of the first guide member along the first axis to the member supporting the product transporting unit, and a sixth portion extending along the third axis between the first and second guide members, with the first and second axes being substantially parallel to each other and the third axis being substantially perpendicular to each of the first and second axes; and a single drive motor fixedly mounted relative to the cabinet and operatively connected to the continuous drive belt, the single drive motor being selectively operated to shift the product transporting unit relative to the cabinet along the first and second axes in order to position the product transporting unit adjacent the selected product, wherein the product transporting unit carries the selected product towards the dispensing chamber.

15. The vending machine according to claim 14, wherein the first and second axes extend substantially horizontally and the third axis extends substantially vertically.

16. The vending machine according to claim 14, further comprising:

a belt tensioning device acting upon the drive belt to maintain a desired belt tension, wherein the product storage zone including a top wall, a bottom wall and opposing side walls, the tensioning device being constituted by first and second spring loaded idler pulley assemblies, the first spring loaded pulley assembly being mounted on one of the opposing side walls adjacent the bottom wall and the second spring loaded pulley assembly being mounted on the one opposing side wall adjacent the top wall.

17. A method of transporting a selected product from a plurality of product queues arranged on a product shelf in a vending machine towards a dispensing chamber arranged within the vending machine, the vending machine including a cabinet, a product storage zone arranged within the cabinet, a plurality of shelves arranged within the product storage zone, each of the plurality of shelves including a plurality of dividers that establish a plurality of product queues, a dispensing chamber arranged within the cabinet, the dispensing chamber including an access opening that provides access to a dispensed product, and a product delivery mechanism that shifts, along multiple axes, to transport a selected product from one of the plurality of products queues towards the dispensing chamber, the product delivery mechanism including first and second guide rails fixedly mounted relative to the cabinet and extending along first and second spaced, substantially parallel axes, a carriage rail extending across the cabinet along a third axis, the carriage rail including a first end portion slidably connected to the first guide rail extending to a second end portion slidably connected to the second guide rail, the first end portion including first and second pairs of grooved rollers on opposite sides of the first guide rail and spaced apart along a length of the first guide rail, the second end portion including third and fourth pairs of grooved rollers on opposite sides of the second guide rail and spaced apart along a length of the second guide rail, wherein circumferential grooves on each of the rollers receives an edge of the first or second guide rail, a carrier member mounted for relative movement along the carriage rail, a first drive belt mounted to the carriage rail, the first drive belt being operatively connected to the carrier member, and a second drive belt mounted in the cabinet, the second drive belt being continuous and including a first portion operatively connected to the first end portion of the carriage rail and extending along a portion of the length of the first guide rail separating the carriage rail from a first end of the first guide rail, substantially parallel to the third axis between the first and second guide rails, along the second guide rail from a first end to a second end of the second guide rail, and along a portion of the length of the second guide rail separating the carriage rail from the second end of the second guide rail, the second drive belt also including a second portion operatively connected to the second end portion of the carriage rail and extending along a portion of the length of the second guide rail separating the carriage rail from a second end of the second guide rail, substantially parallel to the third axis between the first and second guide rails, along the first guide rail from a first end to a second end of the first guide rail, and along a portion of the length of the first guide rail separating the carriage rail from the second end of the first guide rail, the method comprising:

selectively activating a first drive motor supported by the carriage rail and operatively connected to the first drive belt to shift the carrier member along the third axis; and selectively activating a second drive motor fixedly mounted relative to the cabinet and operatively connected to the second drive belt to shift the carrier member at both of the first and second end portions along the first and second axes, wherein the first and second drive motors combine to position the carrier member adjacent a select one of the plurality of product queues on the product shelf, wherein the carrier member carries the selected product towards the dispensing chamber.

18. The method of claim 17, further comprising:

guiding movement of the carriage rail through the use of a plurality of support plates and rollers.

19. The method of claim 17, further comprising:

tensioning the second drive belt.

20. The method of claim 19, wherein the second drive belt is tensioned with a pair of loaded idler pulleys.

* * * * *